United States Patent [19]

Nakao et al.

[11] Patent Number: 4,867,852

[45] Date of Patent: Sep. 19, 1989

[54] ELECTROLYTIC METHOD FOR AFTER-TREATMENT OF CARBON FIBER

[75] Inventors: Fujio Nakao; Nobuyuki Yamamoto; Katumi Anai, all of Otake, Japan

[73] Assignee: Mitsubishi Rayon Co., Ltd., Tokyo, Japan

[21] Appl. No.: 204,262

[22] Filed: Jun. 9, 1988

[30] Foreign Application Priority Data

Jun. 16, 1987 [JP] Japan ..... 62-149936

[51] Int. Cl.[4] ..... C25 1/04

[52] U.S. Cl. ..... 204/130; 204/157.15; 204/157.42; 423/447.1; 423/447.2

[58] Field of Search ..... 204/35.1, 157.42, 56.1, 204/157.15, 130; 423/447.1, 447.2

[56] References Cited

FOREIGN PATENT DOCUMENTS 2407372 8/1974 Fed. Rep. of Germany .
149967 7/1987 Japan .
149970 7/1987 Japan .
1433712 4/1976 United Kingdom .

*Primary Examiner*—John F. Niebling
*Assistant Examiner*—David G. Ryser
*Attorney, Agent, or Firm*—Oblon, Spivak, McClelland, Maier & Neustadt

[57] ABSTRACT

A method for after-treatment of carbon fiber, which comprises by electrolytic oxidation treatment in an aqueous solution having an ammonium ion concentration of 0.2 to 4.0 mol/l and a pH of at least 7 using the carbon fiber as an anode, followed by treating the resulting fiber in water with an ultrasonic wave of at least 20 kHz frequency at an intensity satisfying the condition:

$$\frac{0.014 \times F - 0.28}{1 + \log T} \leqq \text{ultrasonic wave intensity (W/cm}^2\text{)} \leqq \frac{0.091 \times F - 1.45}{1 + \log T}$$

wherein, F is the frequency (kHz) and T is the treatment period (min) provided that $T > 0.1$.

4 Claims, No Drawings

ELECTROLYTIC METHOD FOR AFTER-TREATMENT OF CARBON FIBER

FIELD OF THE INVENTION

The present invention relates to a novel method for after-treatment of carbon filter.

DESCRIPTION OF THE RELATED ART

The light weight and the excellent strength and elastic moduli of composites reinforced with carbon fibers promote the development of their uses over wide areas of applications as components of sporting goods and leisure products and as equipment and materials for aeronautic and space purposes. However, carbon filters used hitherto as reinforcements for composites are not necessarily sufficient in adhesion to matrix resins. Therefore various surface treatment methods such as oxidation treatment with a chemical, vapor-phase oxidation treatment, and electrolytic oxidation treatment have been employed for the purpose of activating the surface of carbon fiber. Of these methods, the electrolytic oxidation treatment is a practically useful method for the surface treatment in view of the better operability and the ease of reaction control.

Heretofore, various electrolytes have been used in the electrolytic oxidation treatment. On the other hand, the electrolytic oxidation treatment leaves oxidized impurities on the surface of carbon fiber, which need to be removed by washing. When warm water is used for this washing, a long time is required for the treatment. No treatment method has yet been found out that can be completed in a short time and does not impair any performance characteristic of carbon fiber.

The use of ultrasonic waves for cleaning is well known. However, ultrasonic waves, when applied to such low-elongation fibers as carbon fibers, may damage fibers themselves under cleaning. Japanese Patent Application Laid-Open No. 149967/87 discloses that carbon fibers after electrolytic oxidation in an acidic electrolyte are allowed by ultrasonic cleaning and inactivated at 400°–900° C., but this patent application does not clarify the effect of this ultrasonic cleaning.

SUMMARY OF THE INVENTION

The primary object of the present invention is to produce carbon fibers which exhibit good composite performance (particularly, interfacial adhesive strength) and are excellent in tensile strength.

For achieving this object, the invention provides a novel method for treating the surface of carbon fiber.

DESCRIPTION OF THE PREFERRED EMBODIMENT

The substance of the present invention is a method for after-treatment of carbon fiber, which comprises electrolytic oxidation treating in an aqueous solution having an ammonium ion concentration of 0.2 to 4.0 mol/l and a pH of at least 7 using the carbon fiber as an anode, followed by treating the resulting fiber in water with an ultrasonic wave of at least 20 kHz frequency at an intensity satisfying the condition:

$$\frac{0.014 \times F - 0.28}{1 + \log T} \leq \text{ultrasonic wave intensity (W/cm}^2\text{)} \leq \frac{0.091 \times F - 1.45}{1 + \log T}$$

wherein, F is the frequency (kHz) and T is the treatment period (min) provided that $T > 0.1$.

There is no particular restriction on the kind of ammonium salt used for preparing the aqueous solution having an ammonium ion concentration of 0.2 to 4.0 mol/l and a pH of at least 7. It is possible to use for example, ammonium carbamate, ammonium carbonate, and ammonium hydrogencarbonate, solely or a mixture of two or more of the above electrolyte. An alkali metal hydroxide such as NaOH or KOH may be used jointly with the ammonium salt for the purpose of raising the conductivity of the electrolytic solution.

Tar mist particles sintered in the carbonization step adhere to the surface of carbon fiber and particles resulting from the oxidation of said mist particles during the surface treatment step adhere to the surface of carbon fiber or deposit in micro-voids among crystals of carbon fiber, thus forming fragile layers or portions. These fragile portions, combining weakly in general to the substrative fiber are in a readily peelable state and are called weak boundary layer in present invention.

In order to enhance the compression-after-impact (CAI) of a fiber-matrix composite, it is important to minimize the peeling of the two components from each other caused by a shock in the composite. Based on the understanding that the oxidation of carbon fiber surface and the simultaneous removal of said weak boundary layer are indispensable in order to minimize the peeling, it has been found that the surface of substrative carbon fiber can be oxidized and the weak boundary layer can be removed at the same time by the electrolytic oxidation treatment of the carbon fiber using it as an anode in an aqueous solution containing ammonium ions at a concentration of 0.2 to 4.0 mol/l and having a pH of at least 7.

Prior to this electrolytic treatment for removing the weak boundary layer, the carbon fiber may be subjected to electrolytic oxidation treatment in an acidic electrolyte aqueous solution for the purpose of introducing oxygen as much as possible into the surface of carbon fiber.

The electrolytic oxidation treatment, however, still leaves oxidized impurities adhering to the surface of carbon fiber.

The present inventors have found that the above phenomena are influenced by the frequency of ultrasonic wave applied and the period of ultrasonic treatment. That is, as shown later in Examples, the lower the frequency of ultrasonic wave, the easier the removal of oxidized impurities but the higher the liability of carbon fiber to damage. Hence, the intensity of ultrasonic wave cannot be much raised when a low-frequency ultrasonic wave is applied. On the contrary, the higher the frequency of ultrasonic wave, the lower the liability of carbon fiber to damage and to napping but the more difficult the removal of oxidized impurities. Hence the intensity of ultrasonic wave cannot be much lowered when a high-frequency ultrasonic wave is applied.

Ultrasonic treatment for a prolonged period removes more oxidized impurities but is liable to damage the carbon filter. The amount of oxidized impurities removed has been found to increase exponentially with the increasing period of ultrasonic treatment.

Hence, the process of the present invention comprises additionally the step of removing these oxidized impurities by the treatment with an ultrasonic wave of at least 20 kHz frequency at an intensity satisfying the following condition:

$$\frac{0.014 \times F - 0.28}{1 + \log T} \leqq \text{ultrasonic wave intensity (W/cm}^2\text{)} \leqq \frac{0.091 \times F - 1.45}{1 + \log T}$$

wherein, F is the frequency (kHz) and T is the treatment period (min) provided that $T > 0.1$.

When the intensity of ultrasonic wave is lower than $$\frac{0.014 \times F - 0.28}{1 + \log T},$$

the removal of oxidized impurities will be insufficient. When the intensity is higher than $$\frac{0.091 \times F - 1.45}{1 + \log T},$$

parts of the carbon fiber break and nap develops.

The higher temperature of this treatment results in the better removal of oxidized impurities. Preferably, the treatment is carried out at a temperature of 60° C. or higher.

The oxidized impurities remaining on the surface of carbon fiber is required to be subjected to ultrasonic treatment so that its amount may be 0.2 or less in term of the absorbance at 230 nm by using a UV spectrometer. When the oxidized impurities show a value of greater than 0.2, the remaining oxidized impurities are not sufficiently removed from the surface of carbon fiber and thus, a carbon fiber having the objective property cannot be obtained.

The treatment of carbon fiber according to the present invention improves its tensile strength markedly. The reason for this is not clear, but it is conceivable that the present treatment may reduce flows of the surface layer and this will improve the strength of carbon fiber outstandingly.

Carbon fibers improved in tensile strength provide composites improved not only in tensile strength but also in CAI. Consequently, the CAI of carbon fiber composites can be improved greatly by the present inventive treatment of carbon fiber wherein weak boundary layer are removed from the surface layer of carbon fiber and flows of the surface layer are reduced.

The CAI depends also greatly on the surface crystal structure of the carbon fiber. When the surface of carbon fiber is occupied in large part by basale-plane graphite crystal, the surface oxidation does not readily take place in the after-treatment process. Even when the surface is oxidized to a certain extent, the oxidized portions will be localized around basale-plane of large graphite crystal and a large portion of the fiber surface will still be occupied by basale-plane of graphite crystal that is considerably passive to matrix resins. Therefore, the effect of the surface oxidation in th after-treatment will be hardly exhibited and the CAI will not be improved. Preferably, the elastic modulus of the carbon fiber to treat does not exceed 40 t/mm$^2$ for the purpose of holding the proportion of graphite crystal area low and improving the CAI to a sufficient level for practical use.

[EXAMPLES]

The following examples illustrate the present invention in more detail.

CAI values of carbon fiber composites were evaluated in accordance with NASA RP1092 as follows:

A prepolymer was prepared by reacting 50 parts by weight (hereinafter parts are all by weight) of bis(4-maleimidophenyl)methane with 450 parts of 2,2-bis(4-cyanatophenyl)propane at 120° C. for 20 minutes. Another prepolymer (2000 parts) was prepared by reacting Epikote 834 (tradename of an epoxy resin supplied by Yuka-Shell Inc., epoxy equivalent weight 250) with 4,4-diaminodiphenyl sulfone in an amino group/epoxy group molar ratio of ¼ at 160° C. for 4 hours, and diluting this reaction product to 80% with epikote 807 (tradename of an epoxy resin supplied by Yuka-Shell Inc., epoxy equivalent weight 170). The two prepolymers were mixed together uniformly at 70° C. for 30 minutes and further mixed uniformly with 100 parts of N-(3,4-dichlorophenyl)-N,N'-dimethylurea, 1 part of dicumyl peroxide, and 25 parts of Aerosil 380 (tradename of a fine silica powder supplied by Nippon Aerosil Co., Ltd.) at 70° C. for 1 hour to give a resin composition. A film was formed from this resin composition by a hot-melt applying system. Using this film and a test sample of carbon fiber, unidirectional prepregs were prepared and laminated together in a quasi-isotropic state of [+45°/0°/45°/+90°] 4S. This laminate was heated at 180° C. for 2 hours to cure the resin. Test pieces (4×6×0.25 inch) were prepared from the hardened laminate. Each test piece was placed on a steel table having a hole (3×5 inch) so that the center of the test piece might be over the hole. A 4.9 Kg weight with a nose having a radius of ½ inch was dropped on the center of the test piece to give a shock of 1500 lbs per inch of thickness of the test piece. Then, the CAI was determined by a compression test on the resulting piece.

The strand strength and elastic modulus of each carbon fiber sample were measured in accordance with JIS R-7601.

The oxidized impurities referred to in the present invention was determined quantitatively by measuring an absorbance. The method thereof comprises immersing 1 g of a carbon fiber sample in 10 g of distilled water, treating the fiber with a 45-kHz ultrasonic wave at 0.2 W/cm$^2$ for 10 minutes while heating the water at 80° C., and the oxidized impurities separate from the surface of carbon fiber and disperse or dissolve in the distilled water. The absorbance of the supernatant at 230 nm by using a UV spectrometer is measured in a UV cell made of quartz having a cell length of 1 cm. A reference liquid is a distilled water. Therefore, the oxidized impurities remaining on the surface of carbon fiber can be quantified by measuring the absorbance of the supernatant with a UV spectrometer.

EXAMPLE 1

An acrylonitrile-based copolymer consisting of 98 wt % of acrylonitrile, 1 wt % of methyl acrylate, and 1 wt % of methacrylic acid was dissolved in dimethylformamide to give a dope of 26 wt % solid content. After filtration through a 10-μ mesh screen and a 3-μ mesh screen, the dope was effected by dry-wet spinning process to form filaments, which were then stretched at a draw ratio of 5:1 in hot water, washed with water, dried, and further stretched at a draw ratio of 1.3:1 in hot air at 170° C., giving a carbon fiber precursor in the form of tows each consisting of 9000 filaments having a filament size of 0.8 denier.

This precursor was subjected to a flame resistance providing treatment by passing through a hot-air circulating type of furnace at 220°–260° C. for 60 minutes while stretching by 15%.

Then, these filaments made flame-resistant were passed under stretching by 8% through a first carbonization furnace having a temperature gradient of from 300° to 600° C. wherein pure nitrogen was flowed, and were further heat-treated for 2 minutes under a tension of 400 mg/d in second carbonization furnace having a maximum temperature of 1300° C. wherein also pure nitrogen was flowed, thus yielding a carbon fiber.

Subsequently, this carbon fiber was subjected to electrolytic oxidation treatment by passing it through an aqueous ammonium hydrogencarbonate solution of 5 wt % concentration (ammonium ion concentration 0.6 mol/l). The carbon fiber was used as an anode by applying a voltage between the fiber and a counter electrode so that 100-coulomb electric charge might flow per 1 g of the carbon fiber. Then, the carbon fiber was treated in 90° C. water for 2 minutes with an ultrasonic wave of 38 kHz frequency at an intensity of 0.46 W/cm$^2$.

The strand strength and elastic modulus of the carbon fiber thus treated were 650 kg/mm$^2$ and 32 t/mm$^2$, respectively, and the CAI of the resulting composite was 38 kg/mm$^2$. The amount of oxidized impurities remaining on this fiber surface was 0.17 in terms of the absorbance measured in the manner stated above.

EXAMPLE 2

A carbon fiber prepared according to the procedure of Example 1 was subjected to electrolytic oxidation treatment in an aqueous ammonium hydrogencarbonate solution of 5 wt % concentration (ammonium ion concentration 0.6 mol/l) at a current density of 150 coulomb/g of the fiber, and then was treated in 90° C. water for 1.0 minute with an ultrasonic wave of 38 kHz frequency at an intensity of 1.0 W/cm$^2$.

The strand strength and elastic modulus of the carbon filter thus treated were 640 kg/mm$^2$ and 32 t/mm$^2$, respectively, and the CAI of the resulting composite was 37 kg/mm$^2$. The amount of oxidized impurities remaining on this fiber surface was 0.15 in terms of the absorbance.

EXAMPLE 3

Carbon fiber treatment was conducted according to the procedure of Example 1 but using an ultrasonic wave of 27 kHz frequency in the second step treatment.

The strand strength and elastic modulus of the treated carbon fiber were 650 kg/mm$^2$ and 32.4 t/mm$^2$, respectively, and the CAI of the resulting composite was 38 kg/cm$^2$. The amount of oxidized impurities remaining on this fiber surface was 0.10 in terms of the absorbance measured in the manner stated above.

COMPARATIVE EXAMPLE 1

A carbon fiber prepared according to the procedure of Example 1 was subjected to electrolytic oxidation treatment in a 5% aqueous phosphoric acid solution at a current density of 20 coulomb/g of the fiber, and then washed with 90° C. water for 15 minutes.

The strand strength and elastic modulus of this treated carbon fiber were 581 kg/mm$^2$ and 31 t/mm$^2$, respectively, and the CAI of the resulting composite was 24.5 kg/mm$^2$. The amount of oxidized impurities remaining on this fiber surface was 0.43 in terms of the absorbance.

COMPARATIVE EXAMPLE 2

A carbon fiber was prepared and treated according to the procedure of Example 1 except that the washing was conducted with 90° C. water for 15 minutes without applying any ultrasonic wave.

The strand strength and elastic modulus of this treated carbon fiber were 590 kg/cm$^2$ and 31.2 t/mm$^2$, respectively, and the CAI of the resulting composite was 35 kg/mm$^2$. The amount of oxidized impurities remaining on this fiber surface was 0.21 in terms of the absorbance.

EXAMPLES 4–7 AND COMPARATIVE EXAMPLES 3 AND 4

According to the procedure of Example 1, a carbon fiber was prepared and treated electrolytically. Equal portions of the resulting fiber were treated separately in 90° C. water for 1 minute with an ultrasonic wave of 38 kHz frequency at different intensities as shown in Table 1.

The amount of oxidized impurities remaining on each portion of carbon fiber thus treated was determined in terms of the absorbance. Results of the determination are shown in Table 1.

TABLE 1

| | Intensity of ultrasonic wave (W/cm$^2$) | Absorbance (230 nm) | Nap of carbon fiber |
|---|---|---|---|
| Example 4 | 0.4 | 0.19 | No |
| Example 5 | 0.8 | 0.15 | No |
| Example 6 | 1.2 | 0.12 | No |
| Example 7 | 1.6 | 0.08 | No |
| Comparative Example 3 | 0.1 | 0.27 | No |
| Comparative Example 4 | 2.4 | 0.10 | Much nap |

EXAMPLES 8–12 AND COMPARATIVE EXAMPLES 5 AND 6

According to the procedure of Example 1, a carbon fiber was prepared and treated electrolytically. Equal portions of the resulting fiber were treated separately in 90° C. water for 1 minute with an ultrasonic wave of 27 kHz frequency at different intensities as shown in Table 2.

The amount of oxidized impurities remaining on each portion of carbon fiber thus treated was determined in terms of the absorbance. Results of the determination are shown in Table 2.

TABLE 2

| | Intensity of ultrasonic wave (W/cm$^2$) | Absorbance (230 nm) | Nap of carbon fiber |
|---|---|---|---|
| Example 8 | 0.2 | 0.18 | No |
| Example 9 | 0.4 | 0.16 | No |
| Example 10 | 0.6 | 0.15 | No |
| Example 11 | 0.8 | 0.11 | No |
| Example 12 | 1.0 | 0.10 | No |
| Comparative Example 5 | 0.05 | 0.26 | No |
| Comparative Example 6 | 1.4 | 0.08 | Much nap |

EXAMPLES 13–18 AND COMPARATIVE EXAMPLES 7 AND 8

According to the procedure of Example 1, a carbon fiber was prepared and treated electrolytically. Equal portions of the resulting fiber were treated separately in 90° C. water for 1 minute with an ultrasonic wave of 45 kHz frequency at different intensities as shown in Table 3.

The amount of oxidized impurities remaining on each portion of carbon fiber thus treated was determined in terms of the absorbance. Results of the determination are shown in Table 3.

TABLE 3

| | Intensity of ultrasonic wave ($W/cm^2$) | Absorbance (230 nm) | Nap of carbon fiber |
|---|---|---|---|
| Example 13 | 0.4 | 0.19 | No |
| Example 14 | 0.8 | 0.18 | No |
| Example 15 | 1.2 | 0.15 | No |
| Example 16 | 1.6 | 0.12 | No |
| Example 17 | 2.0 | 0.08 | No |
| Example 18 | 2.4 | 0.07 | No |
| Comparative Example 7 | 0.1 | 0.32 | No |
| Comparative Example 8 | 3.0 | 0.07 | Much nap |

EXAMPLES 19 AND 20

According to the procedure of Example 1, a carbon fiber was prepared and treated electrolytically. Two equal portions of the resulting fiber were treated separately in 90° C. water with an ultrasonic wave of 100 kHz frequency at different intensities periods of ultrasonic treatment as shown in Table 4.

The amount of oxidized impurities remaining on each portion of carbon fiber thus treated was determined in terms of the absorbance. Results of the determination are shown in Table 4.

TABLE 4

| | Intensity of ultrasonic wave ($W/cm^2$) | Period of ultrasonic treatment (min.) | Absorbance (230 nm) | Nap of carbon fiber |
|---|---|---|---|---|
| Example 19 | 0.43 | 60 | 0.15 | No |
| Example 20 | 0.43 | 90 | 0.15 | No |

EXAMPLES 21-25 AND COMPARATIVE EXAMPLES 9 AND 10

According to the procedure of Example 1, a carbon fiber was prepared and treated electrolytically. Equal portions of the resulting fiber were treated separately in 90° C. water for different periods as shown in Table 5 with an ultrasonic wave of 3.8 kHz frequency at an intensity of 0.5 $W/cm^2$. In Comparative Example 10, the carbon fiber, wound around a plastic bobbin, was subjected to the ultrasonic treatment.

The amount of oxidized impurities remaining on each portion of carbon fiber thus treated was determined in term of the absorbance. Results of the determination are shown in Table 5.

TABLE 5

| | Washing period (min.) | Absorbance (230 nm) | Nap of carbon fiber |
|---|---|---|---|
| Example 21 | 0.5 | 0.19 | No |
| Example 22 | 1.0 | 0.18 | No |
| Example 23 | 5.0 | 0.15 | No |
| Example 24 | 10.0 | 0.11 | No |
| Example 25 | 20.0 | 0.08 | No |
| Comparative Example 9 | 0.2 | 0.23 | No |
| Comparative Example 10 | 1440 | 0.05 | Much nap |

EXAMPLES 26 AND 27 AND COMPARATIVE EXAMPLE 11

A carbon fiber obtained according to the procedure of Example 1 was further heat-treated for two minutes under a tension of 400 mg/d in a third carbonization furnace having a maximum temperature of 1800° C. The thus obtained carbon fiber was subjected to electrolytic oxidation treatment in a 5% aqueous solution of phosphoric acid so that 25-coulomb electric charge might flow per 1 g of the carbon fiber, and subsequently, to electrolytic treatment in a 5% aqueous solution of ammonium hydrogencarbonate so that 100-coulomb electric charge might flow per 1 g of the carbon fiber. This carbon fiber was treated with ultrasonic wave under the conditions shown in Table 6 to obtain the carbon fiber shown in Table 6.

TABLE 6

| | Ultrasonic treatment | | | Strand | | | |
|---|---|---|---|---|---|---|---|
| | Frequency (kHz) | Intensity ($W/cm^2$) | Period (min.) | Strength ($kg/mm^2$) | Elastic modulus ($t/mm^2$) | Absorbance (230 nm) | Nap of carbon fiber |
| Example 26 | 38 | 0.5 | 0.5 | 530 | 35.0 | 0.17 | No |
| Example 27 | 38 | 0.5 | 1.0 | 552 | 35.0 | 0.15 | No |
| Comparative Example 11 | Washing with water at 70° C. for 2 minutes (without ultrasonic treatment) | | | 507 | 34.9 | 0.55 | No |

What is claimed is:

1. A method for after-treatment of carbon fiber, which comprises treating by electrolytic oxidation in an aqueous solution having an ammonium ion concentration of 0.2 to 4.0 mol/l and a pH of at least 7 using the carbon fiber as an anode, followed by treating the resulting fiber in water with an ultrasonic wave of at least 20 kHz frequency at an intensity satisfying the condition:

$$\frac{0.014 \times F - 0.28}{1 + \log T} \leqq \text{ultrasonic wave intensity } (W/cm^2) \leqq \frac{0.091 \times F - 1.45}{1 + \log T}$$

wherein, F is the frequency (kHz) and T is the treatment period (min) provided that $T > 0.1$.

2. The method of claim 1, wherein the ultrasonic treatment is conducted at a temperature of at least 60° C.

3. The method of claim 1, wherein the elastic modulus of the carbon fiber to be treated is not more than 40 $t/mm^2$.

4. The method of claim 1, wherein the amount of matter attached to the surface of the treated carbon fiber is not more than 0.2 in terms of the absorbance at 230 nm measured with a UV spectrometer.

* * * * *